US008297789B2

(12) United States Patent
Liu et al.

(10) Patent No.: US 8,297,789 B2
(45) Date of Patent: Oct. 30, 2012

(54) EMERGENCY EXIT INDICATOR INCORPORATING LED UNIT

(75) Inventors: Tay-Jian Liu, Taipei Hsien (TW); Lin Yang, Shenzhen (CN); Feng Tian, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 337 days.

(21) Appl. No.: 12/868,681

(22) Filed: Aug. 25, 2010

(65) Prior Publication Data

US 2011/0146120 A1 Jun. 23, 2011

(51) Int. Cl.
*F21S 4/00* (2006.01)

(52) U.S. Cl. ..... 362/249.02; 362/812

(58) Field of Classification Search ..... 362/602, 362/612, 616, 147, 183, 249.02, 812
See application file for complete search history.

(56) References Cited

U.S. PATENT DOCUMENTS

| | | | | |
|---|---|---|---|---|
| 3,136,083 | A * | 6/1964 | Guth, Jr. | 362/812 |
| 5,018,290 | A * | 5/1991 | Kozek et al. | 362/812 |
| 5,768,814 | A * | 6/1998 | Kozek et al. | 362/183 |
| 8,024,880 | B2 * | 9/2011 | Kuan et al. | 362/812 |

* cited by examiner

*Primary Examiner* — David V Bruce
(74) *Attorney, Agent, or Firm* — Altis Law Group, Inc.

(57) ABSTRACT

An emergency exit indicator includes a flat housing and a light source received in the housing. The housing has a length greater than a width thereof. The housing includes a panel provided with a sign thereon to indicate emergency exit. The light source includes a plurality of LEDs each being covered by a lens. Light of the LED goes through the lens and is then illuminated on the sign to cause the sign to be visible. The lens has two opposite sides along a lengthwise direction of the housing longer than other two opposite sides along a widthwise direction of the housing, such that the light through the lens along the widthwise direction of the housing is converged in a narrower manner than the light through the lens along the lengthwise direction of the housing.

19 Claims, 10 Drawing Sheets

EMERGENCY EXIT INDICATOR INCORPORATING LED UNIT

BACKGROUND

1. Technical Field

The disclosure generally relates to a lighting apparatus, and particularly to an emergency exit indicator incorporating an LED unit.

2. Description of Related Art

Provision of emergency exits in commercial buildings is required by law. The signs that mark emergency exits are typically used in the case of power failures (blackout), fires, and other emergency situations. An emergency exit indicator is required as a standard equipment for public facilities, such as shopping malls or airplanes. Numerous different types of emergency exit indicators exist in the art including those that use lights to guide people in the direction of an emergency exit door. When the condition requires, the emergency exit indicator is able to indicate the location of an emergency escape exit for people so as to assist people evacuation.

LEDs have been increasingly used in a variety of occasions, such as residential, traffic, commercial, and industrial occasions due to their high light-emitting efficiency. Related emergency exit indicators generally use multiple LEDs arranged along a side of a cover thereof so that the light emitting from the LEDs could radiate through symbols, letters or patterns on the cover to make the symbols, letters or patterns shine or glitter. However, the light emitting from the LEDs is highly directive that the symbols, letters or patterns on the cover cannot be uniformly illuminated, and the light-utilizing efficiency of the indicating lamp is accordingly limited.

What is needed, therefore, is an emergency exit indicator incorporating an LED unit which can overcome the limitations described above.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
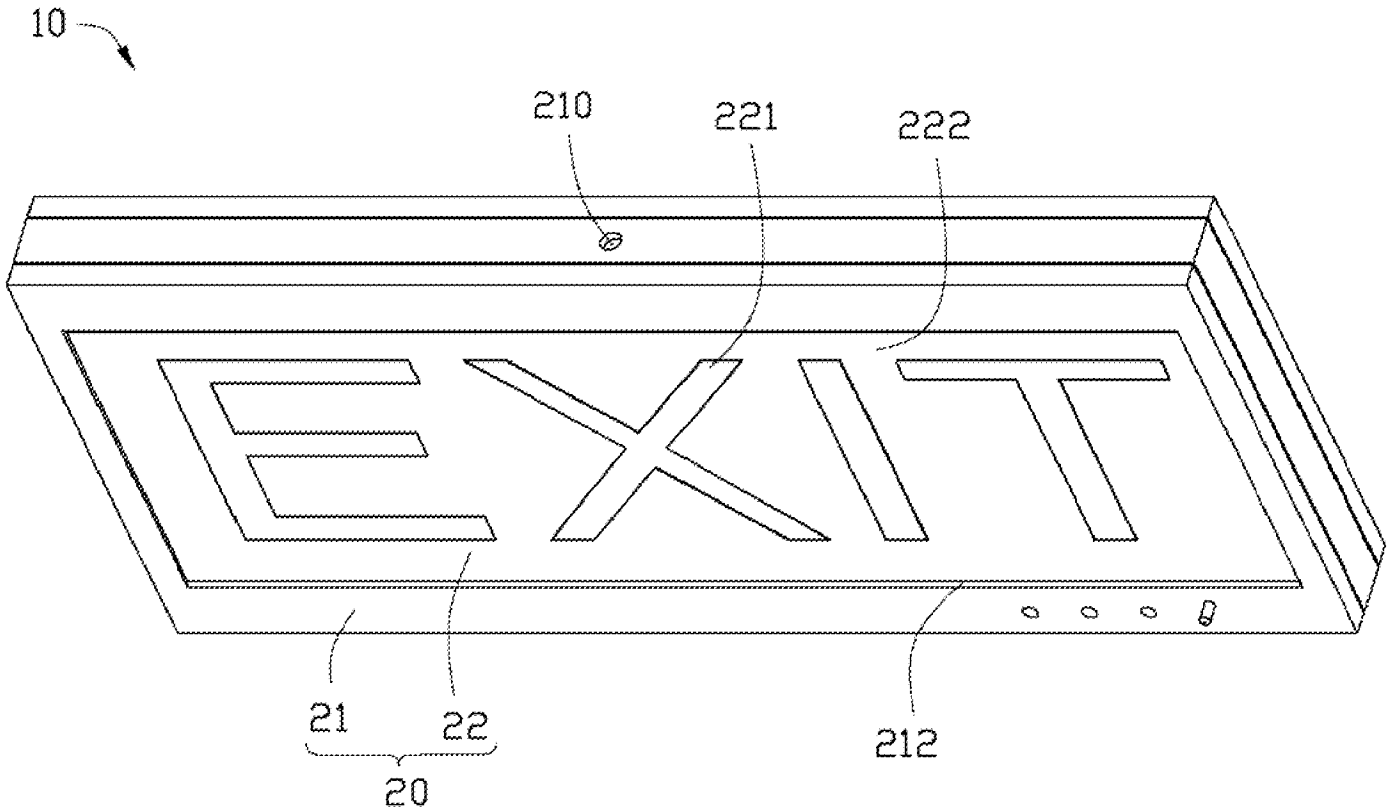
FIG. 1 is an isometric view of an emergency exit indicator according to a first embodiment of the disclosure.
Figure 2:
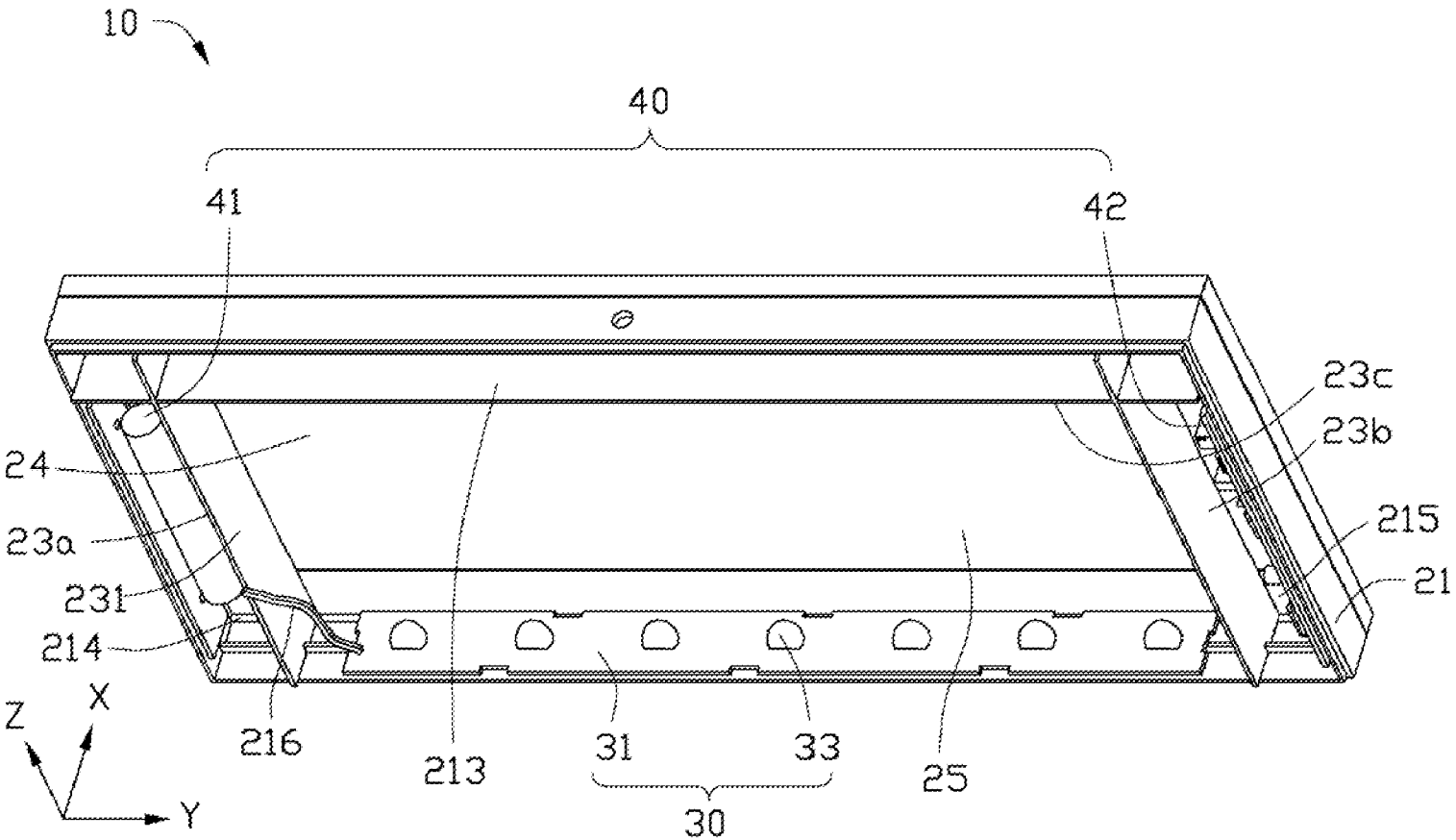
FIG. 2 is similar to FIG. 1, but with a front panel of the emergency exit indicator being removed.

Referring to FIGS. 1 and 2, an emergency exit indicator 10 according to a first embodiment of the disclosure is illustrated. The emergency exit indicator 10 includes a housing 20, a light source 30, and an electrical module 40. The electrical module 40 and the light source 30 are received in the housing 20.

The housing 20 is flat and rectangular. The housing 20 includes a frame 21 and a front panel 22 coupled to the frame 21. The panel 22 is located at a front side of the housing 20. A back plate 25 is mounted at a rear side of the housing 20. The front panel 22 is provided with a sign 221 thereon, wherein the sign 221 may be symbols, letters or patterns that can be used to mark emergency exits. People can see the sign 221 when the sign 221 is illuminated by the light source 30. Other portions of the front panel 22 surrounding the sign 221 is light non-penetrable to form a non-display area 222.

The light source 30 is located at a bottom side in the housing 20. Three spacing plates 23*a*, 23*b*, 23*c* are provided in the housing 20 and arranged adjacent to three other sides (i.e., left side, right side and top side), respectively. An elongated space 214 is defined between the frame 21 and the left-side spacing plate 23*a* for receiving a rechargeable battery 41 of the electrical module 40 therein. An elongated space 215 is defined between the frame 21 and the right-side spacing plate 23*b* for receiving a circuit board 42 of the electrical module 40 therein. An elongated space 213 is defined between the frame 21 and the top-side spacing plate 23*c* for receiving power lines (not shown) therein, wherein the power lines extend out of the housing 20 through a wire hole 210 defined at the top side of the housing 20 for electrically connecting the circuit board 42 with an external alternating current (AC) power source (not shown).

The light source 30 includes a substrate 31 and a plurality of SMD LED units 33 mounted on the substrate 31. The LED units 33 are evenly arranged on the substrate 31 and spaced from each other. A light distribution space 24 is defined in the housing 20 and surrounded by the substrate 31 and the three spacing plates 23*a*, 23*b*, 23*c*. The light emitting from the LED units 33 of the light source 30 enters and is mixed in the light distribution space 24 which is located above the light source 30. After the light is mixed in the light distribution space 24, the light then illuminates uniformly on the sign 221 of the front panel 22 to cause the sign 221 to be visible noticeably. In order to more evenly reflect the light in the light distribution space 24 towards the sign 221, an inner surface of each spacing plate 23*a* (23*b*, 23*c*), an inner surface of the non-display area 222 of the front panel 22 and an inner surface of the back plate 25 may be coated with a light reflecting material to form a light reflecting surface 231.

The rechargeable battery 41 and the circuit board 42 of the electrical module 40 are electrically connected with the substrate 31 of the light source 30 by electrical wires 216. Several circuits are formed on the circuit board 42. Such circuits may include AC to direct current (DC) conversion circuit, battery charging circuit, and control circuit. During operation, the external AC power source is electrically connected with the circuit board 42 by the power lines. The AC to DC conversion circuit on the circuit board 42 converts the AC power provided by the external AC power source into DC power. When the external AC power source is supplied normally, the DC power converted from the external AC power source is supplied to the light source 30 and the rechargeable battery 41. As a result, the light source 30 is turned on to emit light, and at the same time, the rechargeable battery 41 is charged via charging control by the battery charging circuit on the circuit board 42.

When the external AC power source supply is interrupted, the external AC power source can no longer supply power to the light source 30. At this time, the control circuit on the circuit board 42 controls the light source 30 to automatically change to a state in which the rechargeable battery 41 begins to supply DC current to the light source 30 to cause the light source 30 to emit light, such that the light source 30 can emit light in an uninterrupted manner.

In order to describe the embodiment more conveniently, a three-dimensional coordinate system is provided in the figures, wherein the X axis indicates a widthwise direction of the housing 20, the Y axis indicates a lengthwise direction of the housing 20, and the Z axis indicates a height direction of the housing 20. The substrate 31 of the light source 30 is arranged in the housing 20 on a plane defined by the X axis and the Y axis.

Figure 3:
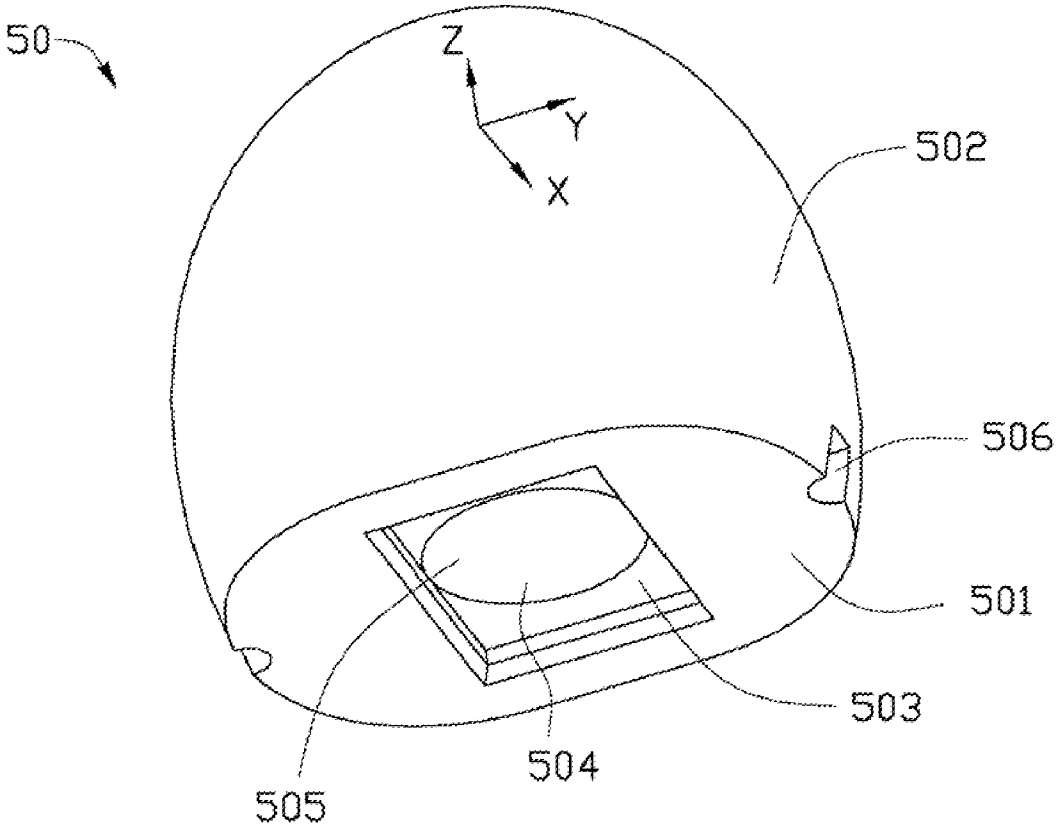
FIG. 3 is an isometric view of a lens for a light source of the emergency exit indicator of FIG. 2.
Figure 4:
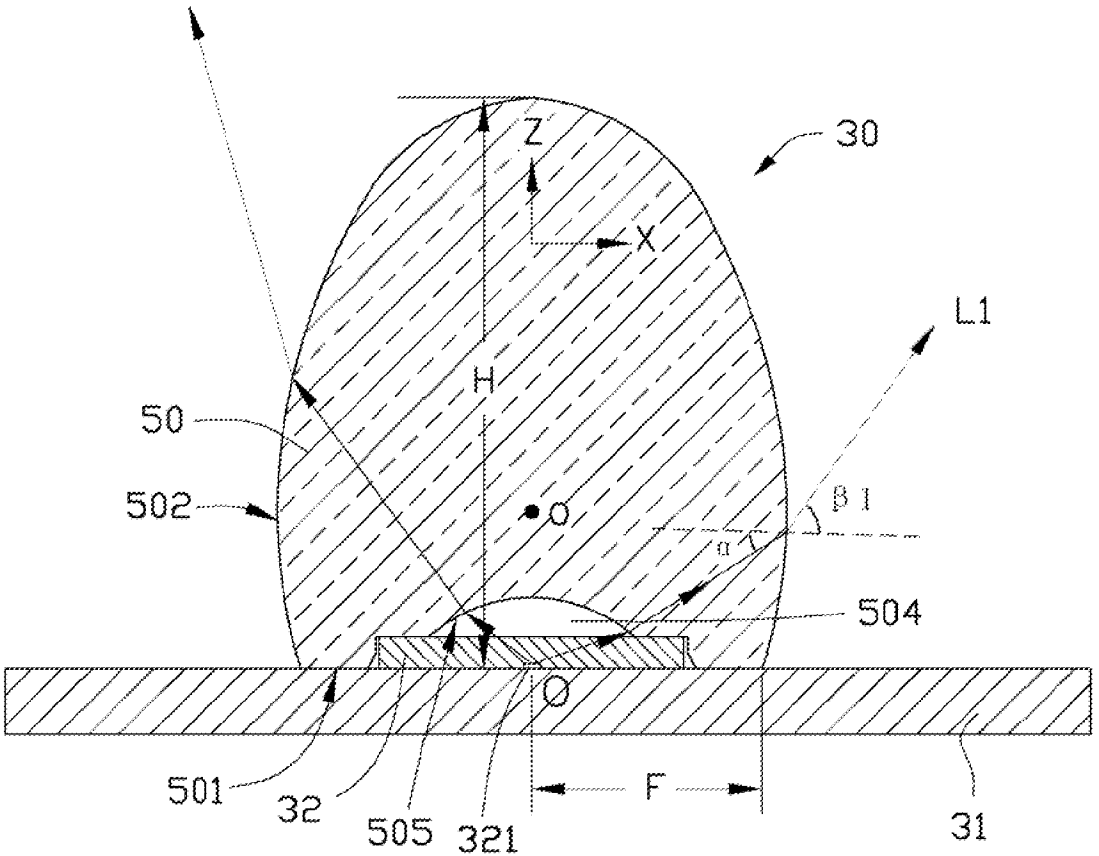
FIG. 4 is a cross-section of the light source with the lens of FIG. 3 along a plane defined by the Z axis and the X axis.
Figure 5:
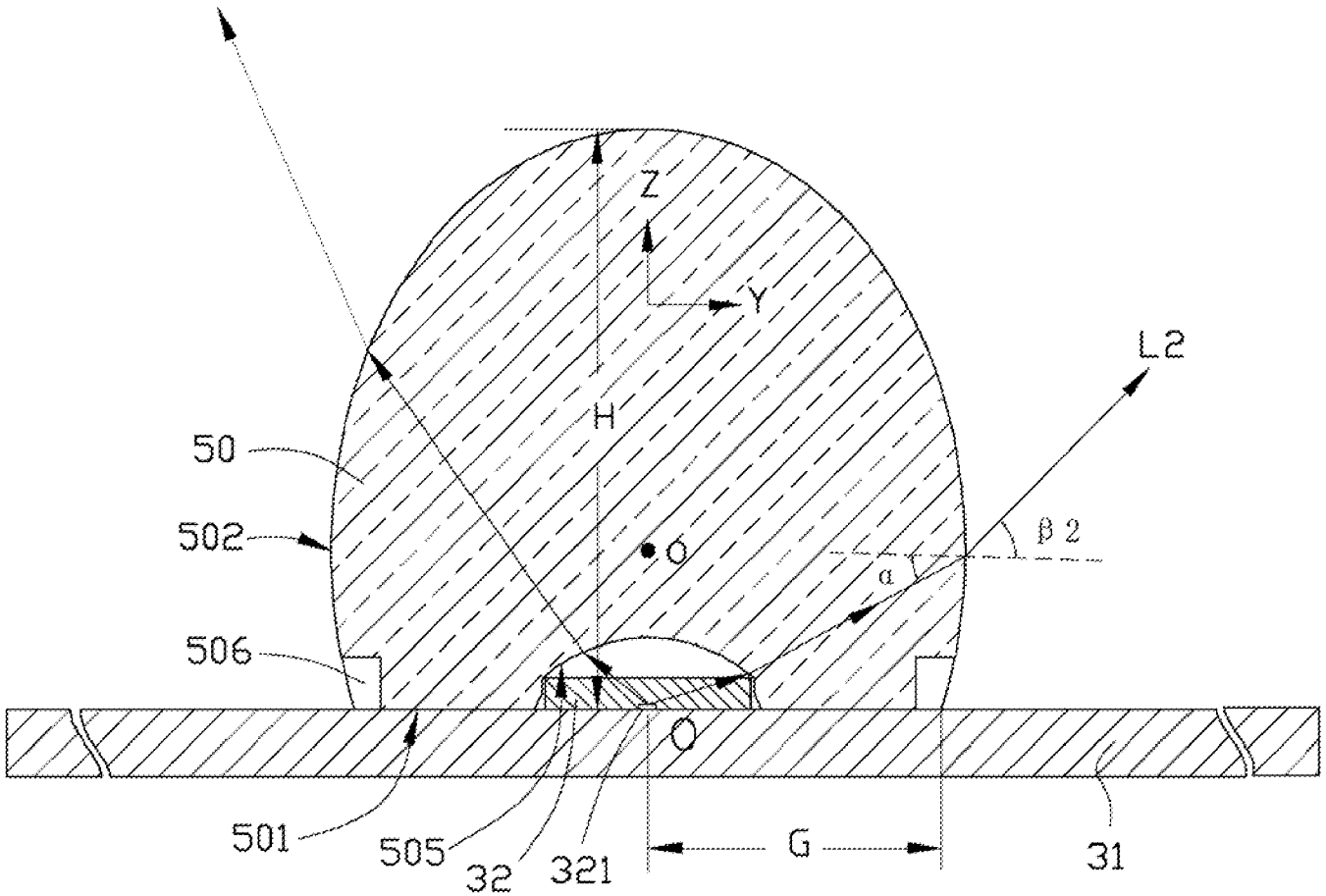
FIG. 5 is a cross-section of the light source with the lens of FIG. 3 along a plane defined by the Z axis and the Y axis.

Referring to FIGS. 3-5, each LED unit 33 includes an LED 32 mounted on the substrate 31 and a lens 50 coupled to the LED 32. The LED 32 includes an LED die 321 which can emit light. The LED die 321 may be a GaN die, a ZnS die, a ZnSe die or other type dies which could emit light with a desirable color. The lens 50 covers on the LED 32 and is fixed to the substrate 31. The substrate 31 may be a metal core printed circuit board (MCPCB), a ceramic printed circuit board (CPCB) or other suitable circuit boards having good heat-conducting capabilities.

The lens 50 is made of transparent materials such as PC (polycarbonate) or PMMA (polymethylmethacrylate). The lens 50 includes a flat bottom surface 501 and an outer surface 502 around the lens 50. In this embodiment, the lens 50 is formed by cutting through a bottom portion of an ellipsoid. Thus, the bottom surface 501 has the shape of an ellipse, and the outer surface 502 of the lens 50 has the shape of an ellipsoid. The bottom surface 501 has a center O at which the LED die 321 is located. The ellipsoid forming the lens 50 has a geometrical center o, wherein the center O of the bottom surface 501 is located below the center o of the ellipsoid. Thus, the lens 50 is in the form of an elongated, truncated ellipsoid.

The lens 50 is mounted on the LED 32 with a major axis of the bottom surface 501 being coincident with the Y axis and a minor axis of the bottom surface 501 being coincident with the X axis. A half length G of the major axis of the bottom surface 501 is longer than a half length F of the minor axis. The lens 50 has a height H along the Z axis. The lens 50 has an area on the plane defined by the X axis and the Y axis, and located above the center O which is gradually decreased from bottom to top along the Z axis.

A rectangular receiving groove 503 is defined in the bottom surface 501 of the lens 50 for receiving the LED 32 therein. A central portion of the receiving groove 503 is further recessed towards the lens 50 to form a spherical cavity 504. The cavity 504 is located above the receiving groove 503 and communicates with the receiving groove 503. An inner surface of the cavity 504 forms as a spherical light-incident surface 505 through which the light emitting from the LED 32 enters the lens 50. The LED 32 is spaced from the light-incident surface 505 by an air gap. A round bottom edge of the light-incident surface 505 connects with two opposite edges of the receiving groove 503 along the Y axis, and spaces from another two opposite edges of the receiving groove 503 along the X axis. A radius of a sphere forming the cavity 504 is greater than a distance between the LED die 321 and one of the edges of the receiving groove 503 along the Y axis. A pair of cutouts 506 are defined in two opposite sides of the lens 50 along the Y axis. Each of the cutouts 506 extends through the bottom surface 501 of the lens 50 to receive glue (not shown) therein to adhesively attach the lens 50 on the substrate 31.

The outer surface 502 of the lens 50 forms as a curved light-emergent surface of the lens 50 through which the light within the lens 50 is refracted out of the lens 50. Referring to FIG. 4, a first light ray L1 emitting from the LED 32 and projecting on a particular point of the outer surface 502 with an incident angle $\alpha$ is refracted out of the lens 50 with an emergent angle $\beta$1 which is greater than the incident angle $\alpha$, whereby the light projecting on the outer surface 502 along the X axis is upwardly converged by the lens 50. Referring to FIG. 5, a second light ray L2 emitting from the LED 32 and projecting on another particular point of the outer surface 502 with an incident angle $\alpha$ is refracted out of the lens 50 with an emergent angle $\beta$2 which is greater than the incident angle $\alpha$, whereby the light projecting on the outer surface 502 along the Y axis is upwardly converged by the lens 50.

Since the lens 50 has the shape like an ellipsoid, the lens 50 has two opposite sides along the Y axis longer than the other two opposite sides along the X axis, such that a curvature of the outer surface 502 along the X axis is greater than a curvature of the outer surface 502 along the Y axis. The light projecting on the outer surface 502 along the X axis is upwardly converged in a narrower manner than the light projecting on the outer surface 502 along the Y axis. As a result, the emergent angle $\beta$1 is greater than the emergent angle $\beta$2.

The housing 20 has a length along the Y axis much greater than a width along the X axis. Due to the presence of the lens 50, the light from the LEDs 32 can enter the light distribution space 24 of the housing 20 effectively and uniformly. Particularly, the light refracted out from the lens 50 along the X axis is converged within a relatively narrower region than the light refracted out from the lens 50 along the Y axis in response to the fact that the housing 20 has a length along the Y axis much greater than a width along the X axis. The light from all of the LEDs 32 is radiated into and mixed in the light distribution space 24 of the housing 20, and then the light is projected on the sign 221 to cause the sign 221 to be illuminated. Thus, the light-utilizing efficiency of the light source 30 is accordingly increased.

Figure 6:
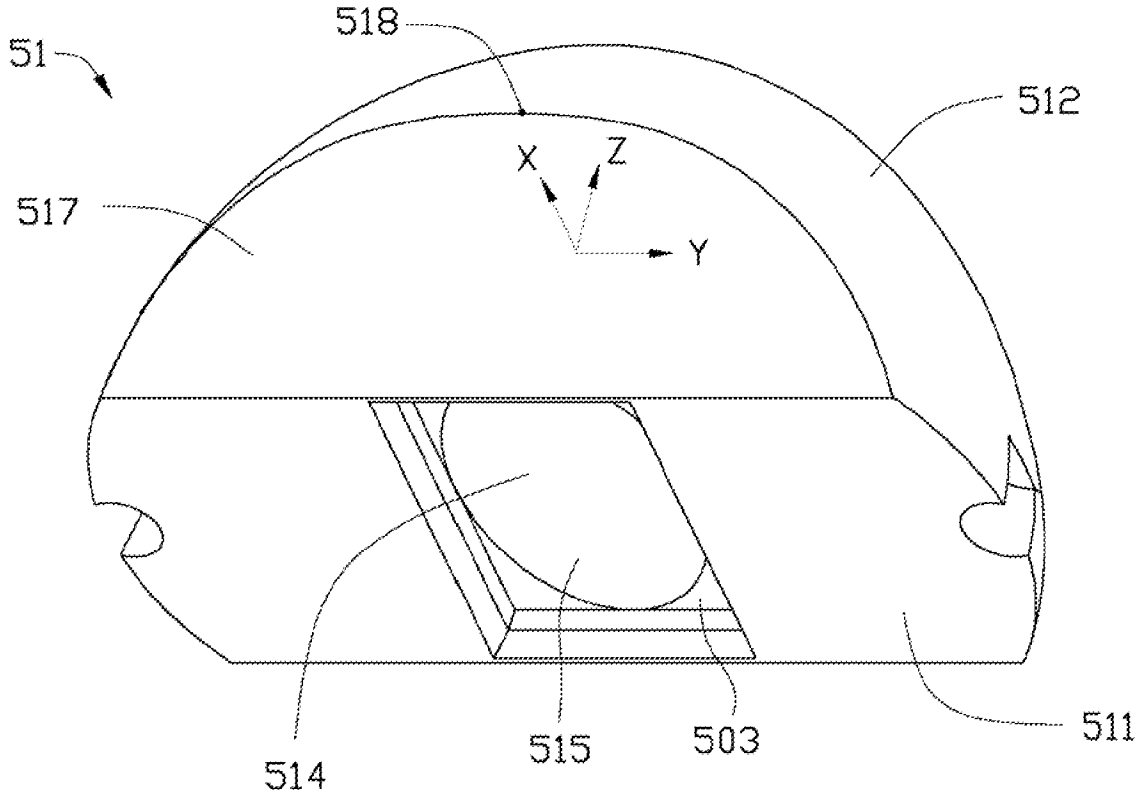
FIG. 6 is an isometric view of a lens for a light source of the emergency exit indicator according to a second embodiment.
Figure 7:
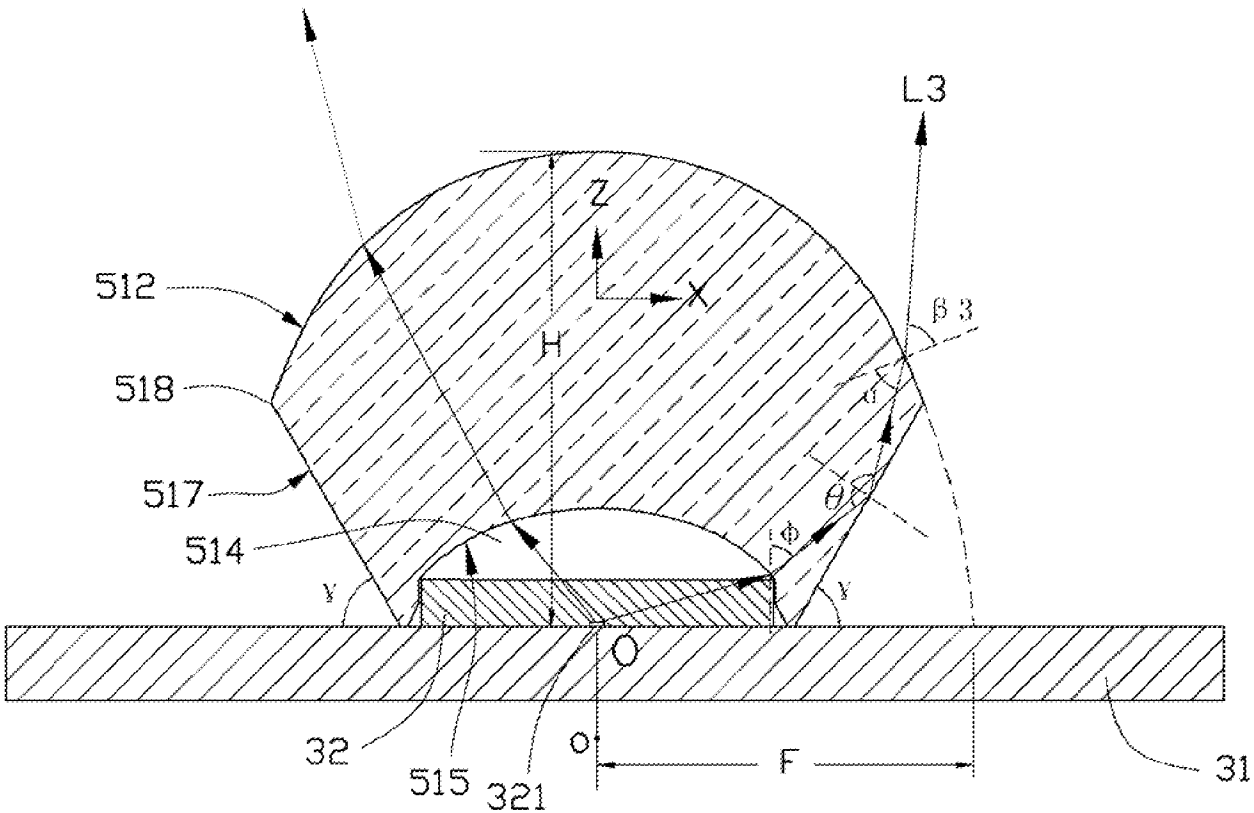
FIG. 7 is a cross-section of the light source with the lens of FIG. 6 along a plane defined by the Z axis and X axis.
Figure 8:
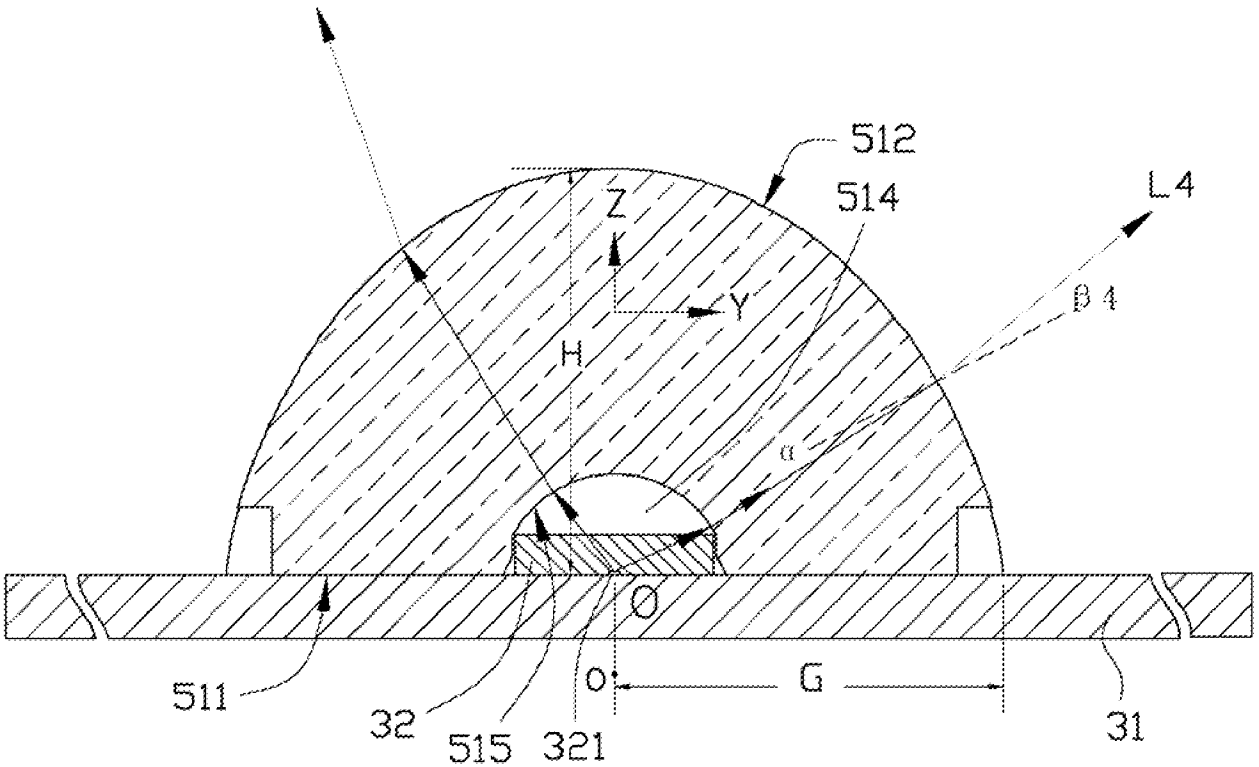
FIG. 8 is a cross-section of the light source with the lens of FIG. 6 along a plane defined by the Z axis and the Y axis.

FIGS. 6-8 show a lens 51 according to a second embodiment. The lens 51 is different from the lens 50 in the following aspects.

The center O of a bottom surface 511 of the lens 51 is located above the center o of the ellipsoid forming lens 51, such that the lens 51 is formed as a shortened, truncated ellipsoid. An inner surface of a cavity 514 of the lens 51 forms as a spherical or ellipsoidal light-incident surface 515 through which the light emitting from the LED 32 enters the lens 51. A round bottom edge of the light-incident surface 515 connects with the four edges of the receiving groove 503, such that the light has less interference between the light-incident surface 515 and the edges of the receiving groove 503. In this embodiment, the light-incident surface 515 is ellipsoidal with a major axis thereof being coincident with the X axis and a minor axis thereof being coincident with the Y axis.

Two opposite side portions of the lens 51 along the X axis are cut away from the lens 51 to form two cutting surfaces 517. Each cutting surface 517 forms an acute angle $\gamma$ with respect to the bottom surface 511, in order to ensure that the light projecting on the cutting surfaces 517 defines a light-incident angle $\theta$ greater than a critical angle $\theta c$ to take place a total reflection on the cutting surfaces 517. The critical angle θc can be calculated by a formula: θc=arcSin(n2/n1), wherein n1 is an refractive index of the lens 51, and n2 is an refractive index of atmosphere. The greater the refractive index of the material made of the lens 51 is, the smaller the critical angle θc will be. For example, the refractive index n1 of the lens 51 made from PMMA is 1.49, and the critical angle θc is 42°; the refractive index n1 of the lens 51 made from PC is 1.59, and the critical angle θc is 39°; the refractive index n1 of the lens 51 made from diamond is 2.24, and the critical angle θc is 26.5°. The emergent light from a vertex 518 of the cutting surfaces 517 just projects on a bottom side 212 (shown in FIG. 1) of the front panel 22. The light projecting on the cutting surfaces 517 below the vertex 518 is totally reflected back into the lens 51 by the cutting surfaces 517, then projects on the outer light-emergent surface 512 and is refracted out of the lens 51 from the light-emergent surface 512, such that the light of the LED 32 is effectively utilized.

The angle γ of each cutting surface 517 is related to the material made of the lens 51 and an angle Φ between the light entering the lens 51 from the light-incident surface 515 and the Z axis. In particular, the relation of γ<(90−Φ)+(90−θc) is established, whereby all of the light projecting on the cutting surfaces 517 are totally reflected back into the lens 51. For example, the angle Φ is 60° or 90°, and the lens 51 is made of PMMA, thus, the angle γ is smaller than 78° or 48°. If the angle Φ is fixed, the greater the refractive index of the material made of the lens 51, the larger the angle γ will be. Preferably, the angle γ is kept within a range of 30° to 75°. In addition, a light reflecting material may be coated on each cutting surface 517 in case a cutting angle beyond the range of the angle γ to increase the light reflective effect.

Referring to FIG. 7, a third light ray L3 emitting from the LED 32 and projecting on a particular point of the outer surface 512 with an incident angle α is refracted out of the lens 51 with an emergent angle β3 which is greater than the incident angle α, whereby the light projecting on the outer surface 512 along the X axis is upwardly converged by the lens 51. Referring to FIG. 8, a fourth light ray L4 emitting from the LED 32 and projecting on another particular point of the outer surface 512 with an incident angle α is refracted out of the lens 51 with an emergent angle β4 which is greater than the incident angle α, whereby the light projecting on the outer surface 512 along the Y axis is upwardly converged by the lens 51. Similarly, the emergent angle β3 is greater than the emergent angle β4.

Figure 9:
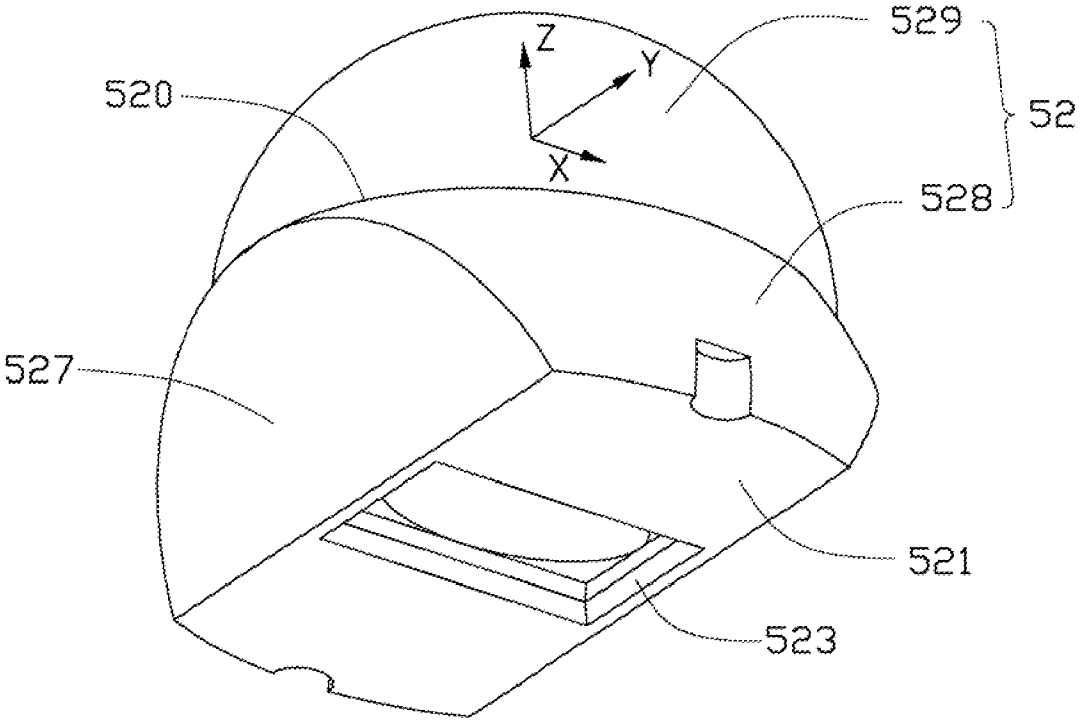
FIG. 9 is an isometric view of a lens for a light source of the emergency exit indicator according to a third embodiment.

FIG. 9 shows a lens 52 according to a third embodiment. The lens 52 is integrally formed with a first lens portion 528 and a second lens portion 529 coupled on the first lens portion 528 along the Z axis thereof. The first lens portion 528 is formed by cutting through a bottom portion of a sphere or an ellipsoid with larger size along a plane defined by the X axis and the Y axis. The second lens portion 529 is formed by cutting through a bottom portion of a sphere or an ellipsoid with smaller size. The first and second lens portions 528, 529 cooperatively form an edge surface 520 at a joint therebetween. In other words, a light-emergent surface of the lens 52 can be derived from the lens 50 of the first embodiment, such that the lens 52 forms the shape of an elongated, truncated sphere or ellipsoid, wherein a center O of a bottom surface 521 of the lens 52 is located below a geometrical center o of the sphere or ellipsoid. Two opposite side portions of the first lens portion 528 along the X axis are cut away to form two cutting surfaces 527 similar to the second embodiment. A rectangular receiving groove 523 is defined in the bottom surface 521 of the lens 52 for receiving the LED 32 therein. The light projecting on the cutting surfaces 527 of the first lens portion 528 is totally reflected by the cutting surfaces 527 into the first lens portion 528 and then is refracted out of the lens 52 from the second lens portion 529 above the first lens portion 528.

Figure 10:
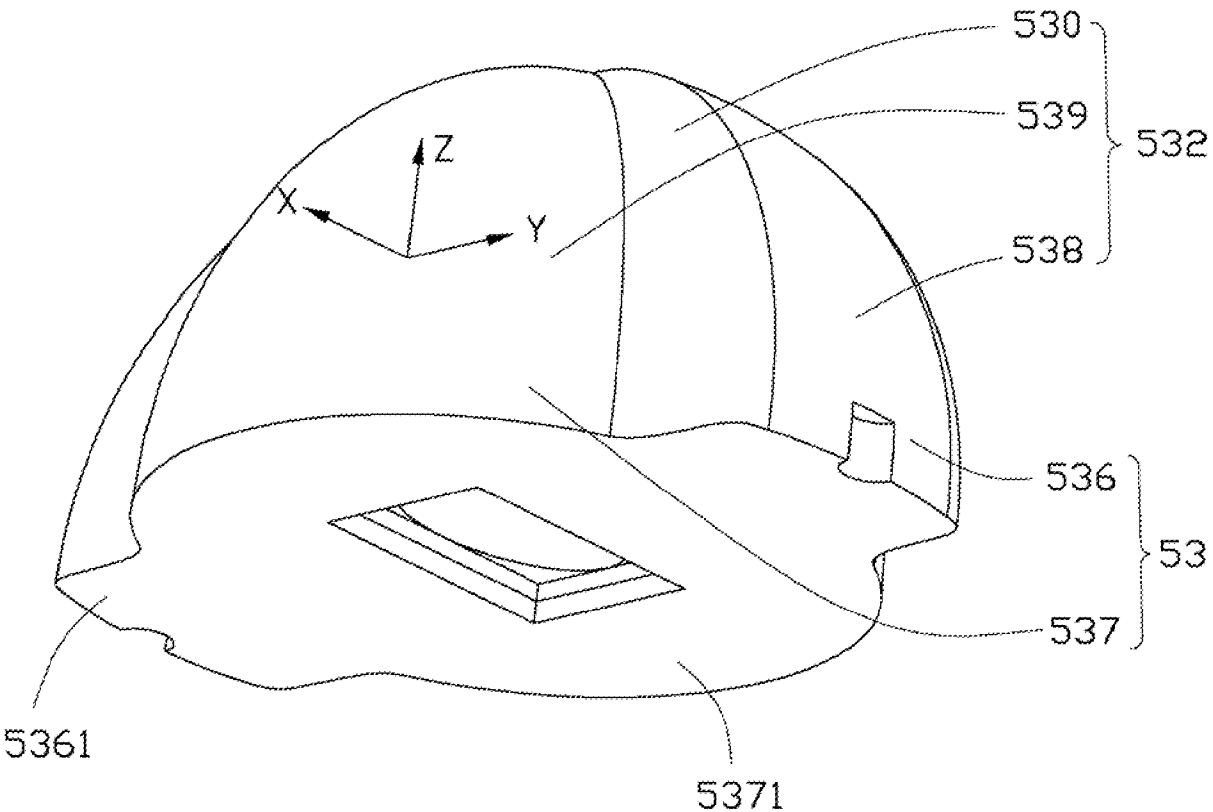
FIG. 10 is an isometric view of a lens for a light source of the emergency exit indicator according to a fourth embodiment.

FIG. 10 shows a lens 53 according to a fourth embodiment. The lens 53 is integrally formed with a first lens portion 536 and a second lens portion 537 intersecting the first lens portion 536 along the Z axis thereof. The first lens portion 536 and the second lens portion 537 have a same height along the Z axis. The first lens portion 536 is formed by cutting through a bottom portion of an ellipsoid with smaller size along a plane defined by the X axis and the Y axis, and is positioned at two opposite sides of the lens 53 along the X axis. The second lens portion 537 is formed by cutting through a bottom portion of a sphere with larger size, and is positioned at two opposite sides of the lens 53 along the Y axis. The first lens portion 536 has a flat elliptic bottom surface 5361 on the plane defined by the X axis and the Y axis. The second lens portion 537 has a flat circular bottom surface 5371 on the plane defined by the X axis and the Y axis and coplanar with the bottom surface 5361 of the first lens portion 536. A major axis of the bottom surface 5361 of the first lens portion 536 is on the Y axis, and a minor axis of the bottom surface 5361 of the first lens portion 536 is on the X axis. The major axis of the bottom surface 5361 of the first lens portion 536 is longer than a diameter of the bottom surface 5371 of the second lens portion 537. The minor axis of the bottom surface 5361 of the first lens portion 536 is shorter than the diameter of the bottom surface 5371 of the second lens portion 537.

A light-emergent surface 532 of the lens 53 includes a portion of ellipsoidal surface 538 at the two opposite sides of the lens 53 along the X axis, a portion of spherical surface 539 at the two opposite sides of the lens 53 along the Y axis, and four edge surfaces 530 interconnecting the portion of ellipsoidal surface 538 and the portion spherical surface 539. The portion of spherical surface 539 exceeds the portion of ellipsoidal surface 538 along the Y axis. The lens 53 can be derived from the lens 51 of the second embodiment. A center O of the bottom surface 531 of the lens 53 is located above a geometrical center o of the ellipsoid forming the first lens portion 536, such that the lens 53 is formed as a shortened, truncated ellipsoid.

In the emergency exit indicator, each LED 32 is coupled with a lens 50 (51, 52, 53). The light from the LED 32 is converged in each of the X axis and the Y axis, and the light in the X axis is converged narrower than in the Y axis, such that the light from all of the LEDs 32 can effectively enter and be mixed uniformly in the light distribution space 24, whereby the light can illuminate on the sign 221 uniformly from the light distribution space 24. In the aforementioned embodiments, the ratio of H/F is between 1 and 10, and the relation of 1<H/G<H/F is established, such that the sign 221 on the front panel 22 of the housing 20 is uniformly illuminated by the light of the LEDs 32.

It is believed that the disclosure and its advantages will be understood from the foregoing description, and it will be apparent that various changes may be made thereto without departing from the spirit and scope of the disclosure or sacrificing all of its material advantages, the examples hereinbefore described merely being preferred or exemplary embodiments.

What is claimed is:

1. An emergency exit indicator, comprising:

a flat housing having a length greater than a width thereof, the housing comprising a panel, a sign provided on the panel to mark emergency exits; and a light source received in the housing, the light source comprising a plurality of LEDs and a corresponding number of lenses each coupled to a corresponding LED, light of the LED going through the lens and then being illuminated on the sign to cause the sign to be visible, the lens comprising two opposite sides along a lengthwise direction of the housing longer than other two opposite sides along a widthwise direction of the housing, the light through the lens along the widthwise direction of the housing converged in a narrower manner than the light through the lens along the lengthwise direction of the housing.

2. The emergency exit indicator of claim 1, wherein the lens is formed by cutting through a bottom portion of an ellipsoid such that the lens comprises a flat bottom surface and an outer surface around the lens, the light of the LED being refracted out of the lens through the outer surface, the bottom surface having the shape of an ellipse, the outer surface of the lens having the shape of an ellipsoid, the LED being received in the flat bottom surface.

3. The emergency exit indicator of claim 2, wherein the bottom surface has a center O, the ellipsoid forming the lens having a geometrical center o, the center O of the bottom surface being located below the center o of the ellipsoid such that the lens is in the form of an elongated, truncated ellipsoid.

4. The emergency exit indicator of claim 2, wherein the bottom surface has a center O, the ellipsoid forming the lens having a geometrical center o, the center O of the bottom surface being located above the center o of the ellipsoid such that the lens is in the form of a shortened, truncated ellipsoid.

5. The emergency exit indicator of claim 2, wherein the bottom surface comprises a major axis along the lengthwise direction of the housing, and a minor axis along the widthwise direction of the housing, a half of a length of the major axis being G, a half of a length of the minor axis being F, the lens having a height H along a height direction of the housing, the value of H/F being located between 1 and 10, the relation of $1<H/G<H/F$ being established.

6. The emergency exit indicator of claim 2, wherein a rectangular receiving groove is defined in the bottom surface of the lens for receiving the LED therein, a central portion of the receiving groove being further recessed towards the lens to form a cavity, an inner surface of the cavity forming as a light-incident surface through which the light emitting from the LED enters the lens.

7. The emergency exit indicator of claim 6, wherein a bottom edge of the light-incident surface connects with two opposite edges of the receiving groove along the lengthwise direction of the housing, and spaces from another two opposite edges of the receiving groove along the widthwise direction of the housing.

8. The emergency exit indicator of claim 6, wherein a bottom edge of the light-incident surface connects with four edges of the receiving groove.

9. The emergency exit indicator of claim 6, wherein the light-incident surface is ellipsoidal with a major axis thereof being coincident with the widthwise direction of the housing and a minor axis thereof being coincident with the lengthwise direction of the housing.

10. The emergency exit indicator of claim 1, wherein the lens is integrally formed with a first lens portion and a second lens portion coupled on the first lens portion along a height direction of the housing, the first and second lens portions cooperatively forming an edge surface at a joint therebetween.

11. The emergency exit indicator of claim 10, wherein the first lens portion is formed by cutting through a bottom portion of a sphere or an ellipsoid with larger size, the second lens portion being formed by cutting through a bottom portion of a sphere or an ellipsoid with smaller size.

12. The emergency exit indicator of claim 1, wherein the lens is integrally formed with a first lens portion and a second lens portion intersecting the first lens portion along a height direction of the housing, the first and second lens portions having a same height along a height direction of the housing and a mutual bottom surface, a light-emergent surface of the lens comprising a portion of ellipsoidal surface at two opposite sides of the lens along the widthwise direction of the housing and a portion of spherical surface at two opposite sides of the lens along the lengthwise direction of the housing, and four edge surfaces interconnecting the portion of ellipsoidal surface and the portion spherical surface, the portion of spherical surface exceeding the portion of ellipsoidal surface along the lengthwise direction of the housing.

13. The emergency exit indicator of claim 12, wherein the first lens portion is formed by cutting through a bottom portion of an ellipsoid with smaller size, the second lens portion being formed by cutting through a bottom portion of a sphere with larger size, a bottom surface of the first lens portion being coplanar with a bottom surface of the second lens portion, a major axis of the bottom surface of the first lens portion being located along the lengthwise direction of the housing, a minor axis of the bottom surface of the first lens portion being located along the widthwise direction of the housing, the major axis of the bottom surface of the first lens portion being longer than a diameter of the bottom surface of the second lens portion, the minor axis of the bottom surface of the first lens portion being shorter than the diameter of the bottom surface of the second lens portion.

14. The emergency exit indicator of claim 1, wherein two opposite side portions of the lens along the widthwise direction of the housing are cut away from the lens to form two cutting surfaces, the light emitting from the LED and projecting on the cutting surfaces being totally reflected back into the lens by the cutting surface.

15. The emergency exit indicator of claim 14, wherein each of the cutting surfaces forms an angle $\gamma$ with respect to a bottom surface of the lens, an angle $\Phi$ being defined between a height direction of the housing and the light entering the lens from a light-incident surface of the lens, the lens having a critical angle $\theta c$, the relation of $\gamma<(90-\Phi)+(90-\theta c)$ being established.

16. The emergency exit indicator of claim 15, wherein the angle $\gamma$ is kept within a range of 30° to 75°.

17. The emergency exit indicator of claim 1, further comprising an electrical module received in the housing, the electric module comprising a circuit board and a rechargeable battery electrically connected with the circuit board, when an electrical power is supplied normally to the light source, the light source emits light and the rechargeable battery is charged, and when the electrical power is interrupted, the rechargeable battery supplies power to the light source.

18. The emergency exit indicator of claim 1, wherein the light source is located at a bottom side in the housing, a light distribution space bring defined in the housing above the light source, the light from the LEDs of the light source entering and being mixed in the light distribution space before the light illuminates on the sign.

19. The emergency exit indicator of claim 17, wherein the light source further comprises a substrate arranged along the lengthwise direction of the housing, the LEDs being evenly spaced from each other on the substrate.

* * * * *